US006206279B1

(12) United States Patent
Countee

(10) Patent No.: US 6,206,279 B1
(45) Date of Patent: Mar. 27, 2001

(54) EXPANDABLE, STAY-OPEN SNACK PACKAGE

(75) Inventor: Joseph Countee, Somerset, NJ (US)

(73) Assignee: Nabisco Technology Company, Wilmington, DE (US)

( * ) Notice: Subject to any disclaimer, the term of this patent is extended or adjusted under 35 U.S.C. 154(b) by 0 days.

(21) Appl. No.: 09/164,567

(22) Filed: Oct. 1, 1998

(51) Int. Cl.[7] ..... B65D 5/08

(52) U.S. Cl. ..... 229/117.27; 229/117.35; 229/123; 229/155; 229/935

(58) Field of Search ..... 229/101, 123, 229/117.27, 125, 155, 933, 935, 117.35

(56) References Cited

U.S. PATENT DOCUMENTS

| | | | | |
|---|---|---|---|---|
| Re. 34,347 | * | 8/1993 | Van Erden et al. | 229/117.35 |
| D. 374,204 | | 10/1996 | Weder . | |
| 641,500 | | 1/1900 | Davidson . | |
| 1,995,516 | | 3/1935 | Miller . | |
| 2,095,910 | * | 10/1937 | Bergstein | 229/117.27 |
| 2,151,202 | * | 3/1939 | Guyer | 229/117.27 |
| 2,176,912 | | 10/1939 | Luckett . | |
| 2,395,663 | | 2/1946 | Howard . | |
| 2,540,342 | | 2/1951 | Moore . | |

(List continued on next page.)

*Primary Examiner*—Gary E. Elkins

(57) ABSTRACT

A reclosable, stackable, standable package for food products such as baked goods easily converts from a parallelepiped form to a widened shape on top for easy access to the snack which is contained within an inner liner bag. The package stays in a widened open configuration throughout hand-to-mouth snacking even while resting on its front or back panel. The outer carton of the package has score lines on the front and the back panels of the carton extending from the lower corners of the front and the back panels to the center of the upper edge of the front and the back panels. Score lines also extend across the center of the top front and back flaps. The score lines in combination with the disconnected top flaps design not only allows the top of the package to form a wide oval shaped opening for easy access to the packaged goods, but also allows the package to stay opened while snacking. Also, the expanded package does not tip or rock during snacking, but rather keeps in stable contact with an underlying at least substantially flat support surface.

19 Claims, 4 Drawing Sheets

U.S. PATENT DOCUMENTS

| | | | | |
|---|---|---|---|---|
| 2,634,900 | | 4/1953 | Levkoff . | |
| 2,773,636 | | 12/1956 | Williams et al. . | |
| 2,791,367 | | 5/1957 | Mefford . | |
| 2,853,225 | | 9/1958 | Bauer . | |
| 2,865,498 | | 12/1958 | Ringler . | |
| 2,933,232 | | 4/1960 | Bugnone . | |
| 2,935,238 | | 5/1960 | Koehler . | |
| 2,995,288 | | 8/1961 | Jesinghaus . | |
| 3,004,696 | | 10/1961 | McCormick . | |
| 3,032,249 | | 5/1962 | Kollar et al. . | |
| 3,083,889 | * | 4/1963 | Christensson | 229/117.35 |
| 3,172,594 | | 3/1965 | Kuchenbecker . | |
| 3,269,644 | | 8/1966 | Bump . | |
| 3,578,236 | | 5/1971 | Arai . | |
| 3,809,310 | | 5/1974 | Vanderlugt, Jr. . | |
| 3,845,897 | | 11/1974 | Buttery et al. . | |
| 3,877,632 | | 4/1975 | Steel . | |
| 4,063,679 | | 12/1977 | Henry . | |
| 4,191,324 | | 3/1980 | Kitagawa . | |
| 4,260,097 | | 4/1981 | Nold . | |
| 4,388,993 | | 6/1983 | Lavery . | |
| 4,437,570 | | 3/1984 | Sorenson . | |
| 4,742,955 | | 5/1988 | Focke et al. . | |
| 4,955,528 | | 9/1990 | Schuluckebier . | |
| 5,014,907 | | 5/1991 | Hollander et al. . | |
| 5,074,462 | * | 12/1991 | Countee, Jr. | 229/155 |
| 5,098,014 | | 3/1992 | Perkins . | |
| 5,292,058 | | 3/1994 | Zoss et al. . | |
| 5,310,077 | | 5/1994 | McDermott et al. . | |
| 5,356,069 | | 10/1994 | Bochet et al. . | |
| 5,437,406 | | 8/1995 | Gordon et al. . | |
| 5,452,844 | | 9/1995 | Bochet et al. . | |
| 5,716,138 | | 2/1998 | Southwell . | |
| 5,720,428 | | 2/1998 | Jensen . | |
| 5,752,649 | | 5/1998 | Weder . | |
| 5,779,135 | * | 7/1998 | Richardson | 229/155 |
| 5,884,800 | | 3/1999 | Hall . | |

* cited by examiner

EXPANDABLE, STAY-OPEN SNACK PACKAGE

FIELD OF THE INVENTION

This invention relates to a package for snack foods such as crackers, chips, and cookies which stays open in an expanded or widened position for hand-to-mouth snacking. The present invention also relates to a blank of a card board-type material for making a stay-open snack carton. products comprising a carton and an inner liner bag.

BACKGROUND OF THE INVENTION

A wide variety of snack foods such as chips, pretzels, popcorn, and cookies are packaged in flexible film bags for easy hand access to the products for hand-to-mouth snacking. The flexible bags generally readily deform due to the application of external and internal hand pressure so as to permit the human hand to be inserted into the package, grab the snack, and remove it for consumption. The product contents tend to settle so as to maintain the flexible bag in an expanded or more rounded configuration for continued hand-to-mouth consumption. However, flexible bags are not readily stackable upon each other or standable for presentation upon grocery shelves or displays. Additionally, flexible bags do not provide adequate protection against crushing of the contents during transportation or handling compared to protection afforded by cartons or paperboard packaging.

The packaging of baked goods such as cookies, crackers, cereals, and fabricated snack chips in a carton or paperboard box which contains an inner, sealed flexible bag or liner for retaining product freshness also provides stackability, standability, and protection against product breakage. Generally, the shape of such packages is a rectangular parallelepiped with a relatively narrow width allowing the package to be easily held in one hand and providing large front and back panels for product identification. However, the width of the opening on top of the package is also relatively narrow due to the narrow width of the package. Normally, the package has to be deformed at the top by the hand which is inserted into the package to allow the products to be removed from the package by hand. Additionally, even when the package is resting on a solid surface, one's other hand is generally needed to hold the package still or deform it while product is being gathered in the package or removed for consumption. For example, when the package is resting on one of its major panels insertion of one's hand into the package for removal of the product tends to slide the package away from the consumer unless the package is held by the other hand. Snack packages normally contain more than one portion of the product requiring repeat extraction of the product from the package. When the consumer desires to extract small portions of the product repeatedly during a short period of time, such as for hand-to mouth snacking, it becomes inconvenient to deform the package and/or hold it every time the next portion of the food is removed from the package.

Packages with an expandable top opening are disclosed in U.S. Pat. No. 5,292,058 to Zoss et al and U.S. Pat. No. 2,176,912 to Luckett. Zoss et al discloses an expandable top package with a front and a back panel with score lines which are parallel, or are in a Y- shape, an inverted Y-shape, a V-shape, or an inverted V-shape. The panels can be flexed into a non-planar shape with the upper edges of the package being open widely in an oval shape for access of a measuring cup, thereby avoiding the need to pour out dry ingredients.

Luckett discloses a tobacco pouch or container which is provided with fold lines that allow the user to squeeze the pouch and spread the top of the pouch wide open and form a spout through which the contents can be easily poured out of the pouch.

However, the packages of Zoss et al and Luckett are not disclosed as staying open during a prolonged amount of time, throughout repeat extractions of the packaged goods from the package when it is laid down or resting on its major surfaces. The design of the package disclosed in Zoss et al does not allow the package to be laid flat or rested on the front or the back panel and remain open. Zoss et al explicitly discloses that spacing the score lines from the side edges and bottom edges of the package will give rigidity to the front and back panels and assist in their return to a planar condition. The packages or containers disclosed in Luckett comprise side flaps that are attached to the front flaps and contain fold lines that facilitate closing of the package and prevent the package from staying open once the force that squeezes the package is removed. The package disclosed in Luckett is intended to stay closed between the extractions of tobacco. Furthermore, the reference explicitly teaches away from any inner liner bags that can interfere with access to the contents of the package.

The present invention provides a reclosable, stackable, standable package for baked goods such as crackers, fabricated snacks or other snack products that is of a conventional parallelepiped form when closed. However, when opened, the package easily converts to a widened shape on top for easy access to the snack. The package stays in a widened open configuration throughout hand-to-mouth snacking even while resting on its front or back panel. The snacking may be performed using one hand without the application of external or internal hand pressure from the other hand to keep the wide open configuration or to prevent excessive sliding of the package.

SUMMARY OF THE INVENTION

The present invention provides a stackable, standable, recloseable package which is expandable to permit easy hand access to its contents for hand-to-mouth snacking. The package remains in its expanded, or widened configuration for continuous snacking even when rested or laid down on its major surfaces. The package comprises an outer carton and an inner liner bag for packaging food products such as crackers, ready-to-eat cereals, cookies, chips or other snack foods. The outer carton comprises a front panel and a back panel, two side panels, a top and a bottom front flap, a top and a bottom back flap and two top and two bottom side flaps. The top flaps are not connected to each other, and the side flaps, preferably, have no folding score lines. The outer carton of the package comprises score lines on the front and the back panels of the carton extending from the lower corners of the front and the back panels to the center of the upper edge of the front and the back panels. Score lines also extend across the center of the top front and back flaps. The score lines in combination with the top flaps design not only allows the top package to form a wide oval shaped opening for easy access to the packaged goods, but also allows the package to stay opened while snacking.

DETAILED DESCRIPTION OF THE INVENTION

Figure 1:
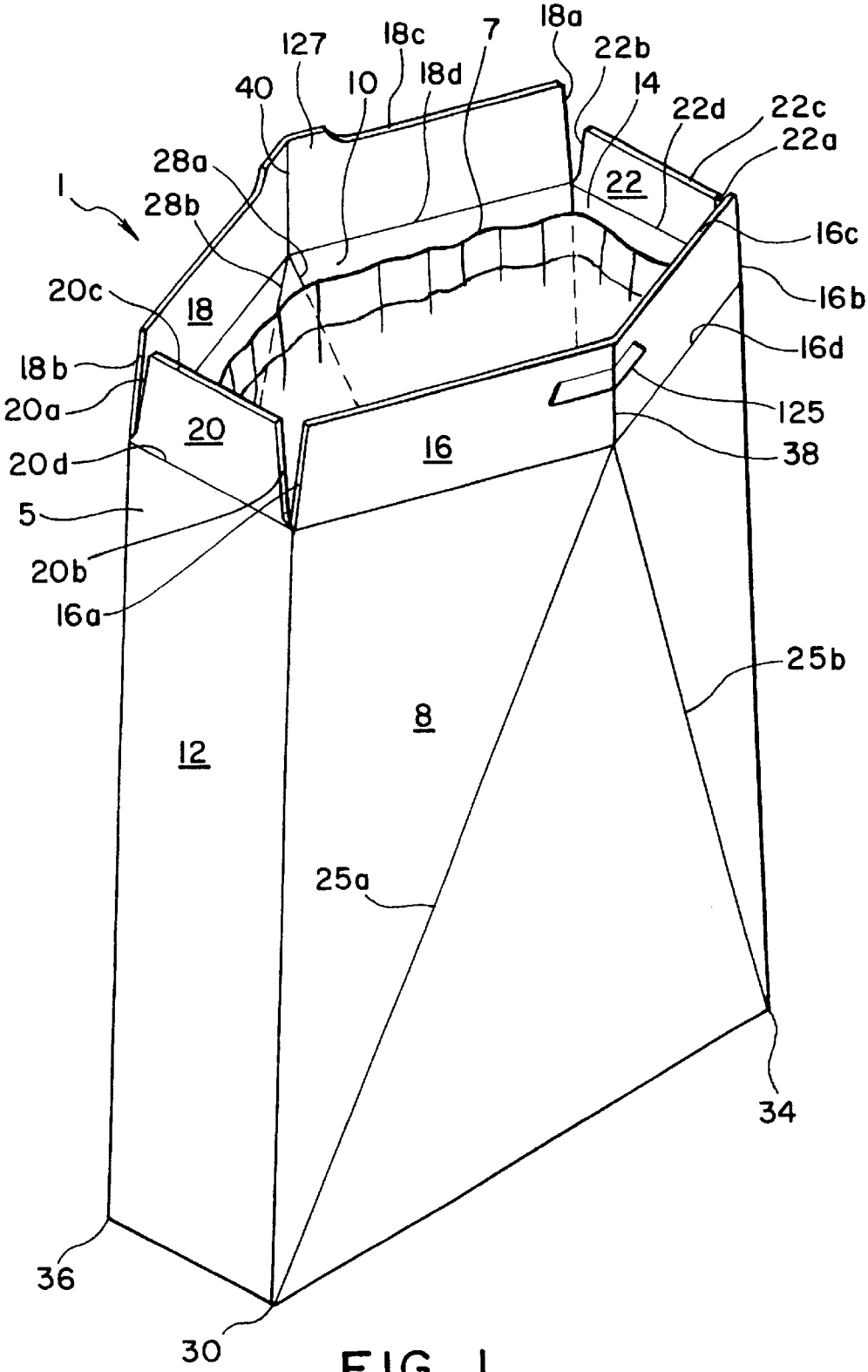
FIG. 1 shows a perspective view of an open package with the wide opening on top of the box according to the invention, taken from the top, front, and left side.

The package according to the present invention is a stay-open package for food products having an expandable top opening. The package of the invention provides a convenient package design for various food products such as fabricated chips, potato chips, crackers, pretzels, cookies, ready-to-eat cereals or other snack items that are not usually taken out of the package at once, but are usually removed from the package in small portions. The package, when it is opened on top and slightly squeezed inwardly from the sides, forms and retains a bowl shape, or wide oval-shaped or hexagonal opening, as shown in FIG. 1, for easy access to the products stored within the package. The package remains wide open for as long as it is desired by the consumer without the application of additional external force, thus making "snacking" from the package very convenient. The package allows the user easy access and removal of individual pieces or portions of the snack from the package without holding the package. The hexagonal opening is wide enough to allow the snack to be easily removed from the package by an adult human hand. The package will remain opened when resting on one of its front or back panels. The snack product settles and conforms to the expanded shape and helps to maintain it for snacking. Hand insertion and removal and product grasping may be accomplished with one hand without the need to maintain the package stationary with the other hand. The package may be returned to its original, planar shape or configuration by the application of light, opposing hand pressure to the front and back panels while gently shaking the contents.

As shown in FIG. 1, the package 1 according to the present invention comprises an outer carton 5 and an inner liner bag 7. In embodiments of the invention, the package 1 can be a reclosable package having reclosable flaps on top of the outer carton 5, or a reclosable or resealable, inner bag, or both a reclosable carton and a reclosable inner bag. The reclosable top flaps and reclosable inner seals may be those conventionally used in the art. Exemplary reclosable top flaps which may be used are known interlocking tab and slot flaps. Exemplary reclosable inner seals which may be employed on the inner bag are known resealable adhesive seals, interlocking reclosable profiles, and adherent wire ties. In other embodiments, the inner bag 7 may be initially permanently sealed with an adhesive, such as a hot melt adhesive, or heat seal.

The inner liner bag 7 that contains the food product can be made of conventional, food grade metallic, paper or plastic films, such as heat-sealable plastic films. The inner liner bag 7 may be unattached to the carton 5 or adhesively attached to the carton 5 in a manner which does not interfere with expansion of the carton 5. Adhesive attachment may be by conventional adhesives applied to one or more spots or small portions of the bottom or one or more panels inside of the carton.

The outer carton 5 can be made from a cardboard-type single layer material or from a thick paper that, when folded, can retain the folded shape of the box. The preferred material of the outer carton 5 is a thick cardboard which retains well the shape of either the closed package or the opened, expanded package. If the material for the carton 5 is not sufficiently stiff, the carton 5 will not be able to remain open after the squeezing force is removed. An exemplary cardboard thickness may range from about 16 pt. to about 28 pt. or from about 0.016 in. to about 0.028 in.

Figure 2A:
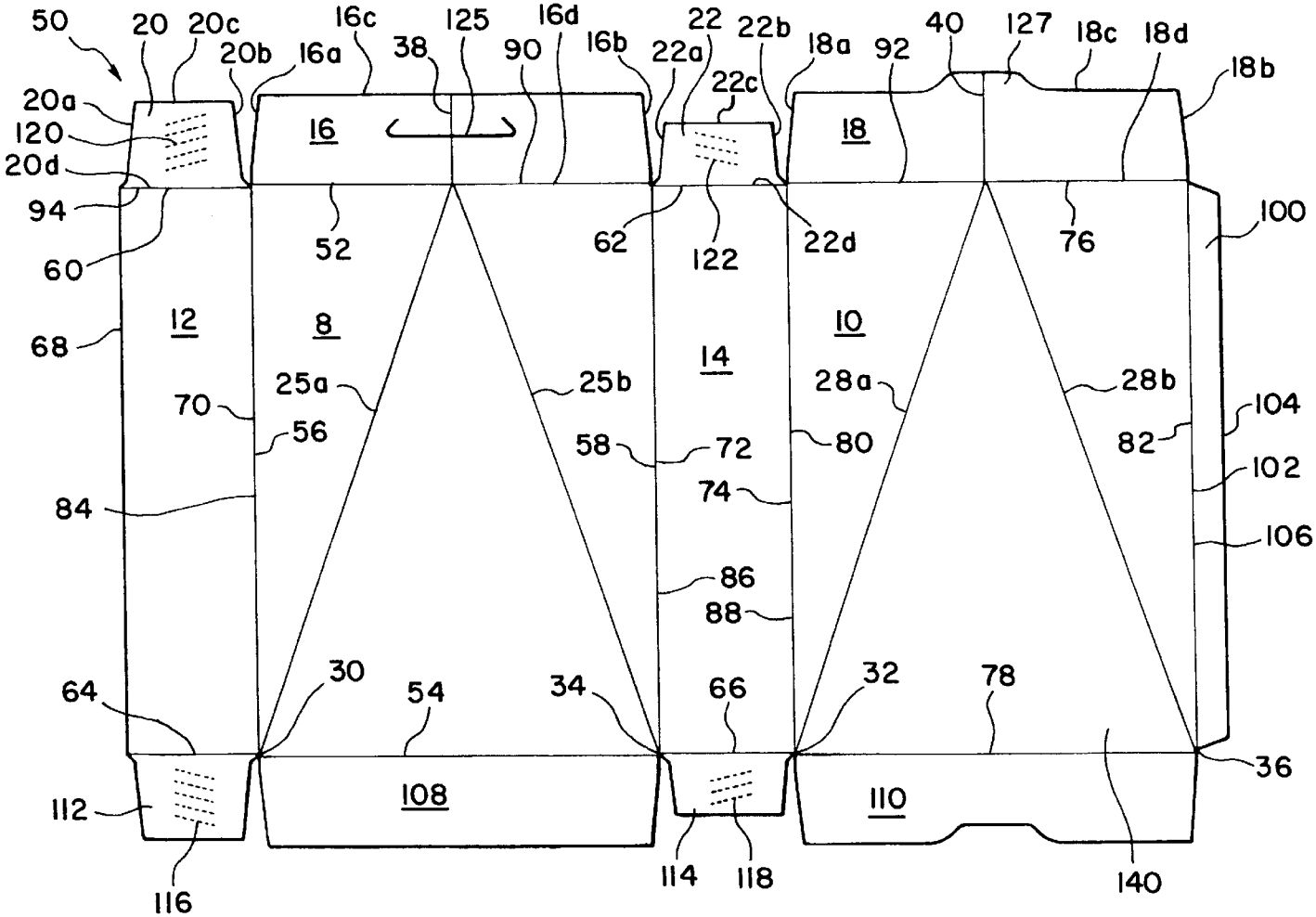
FIG. 2*a* shows a top plan view of a blank from which the carton of the package shown in FIG. 1 is made.
Figure 2B:
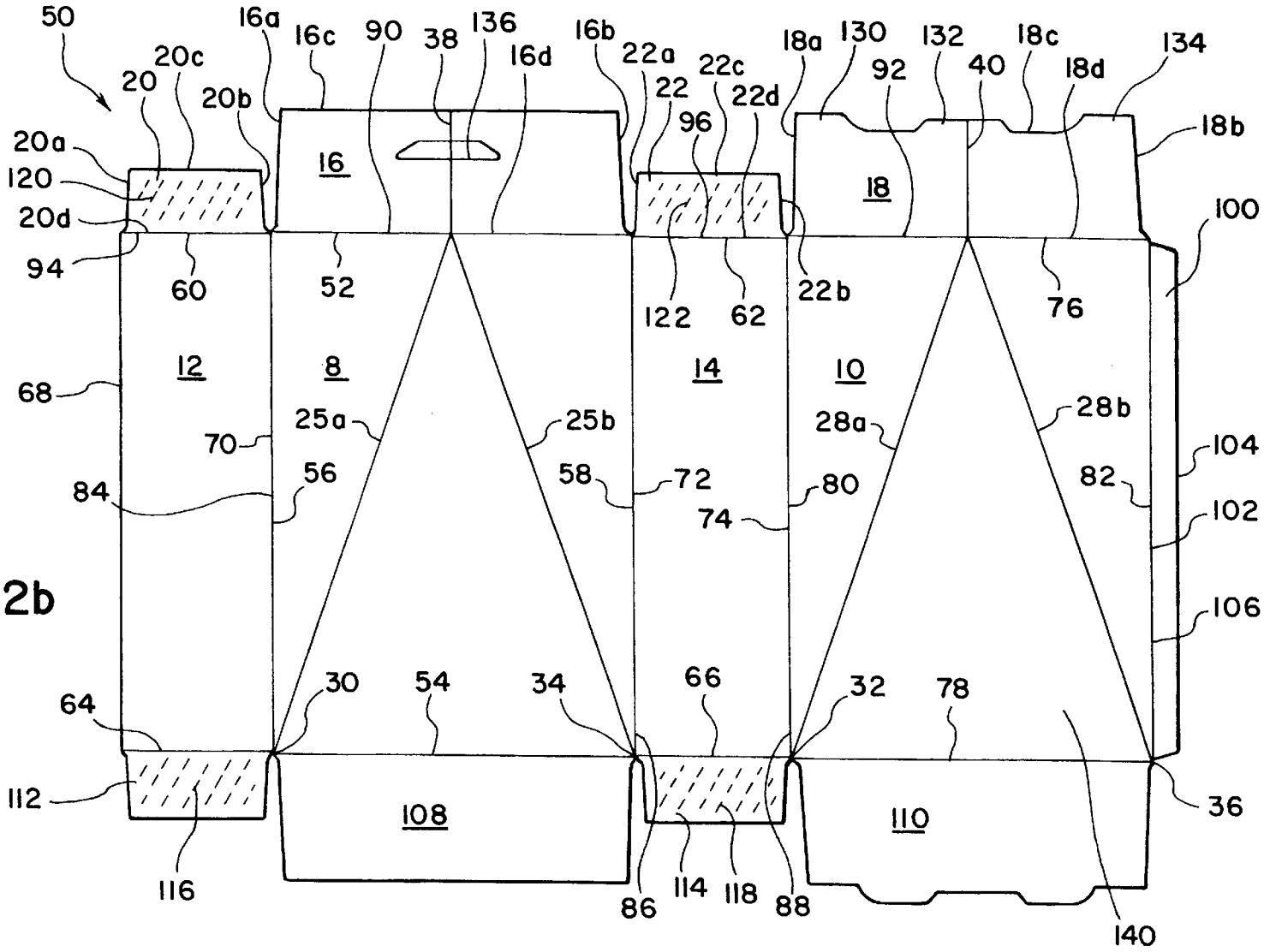
FIG. 2*b* shows a top plan view of an alternative blank form from which a carton in accordance with the present invention can be made having alternative recloseable top flaps.

As shown in FIGS. 1, 2*a* and 2*b*, the carton 5 comprises two at least substantially equal major panels, a front panel 8 and a back 10 panel of a rectangular shape. It also has two opposing at least substantially equal side panels 12, 14, and four top flaps 16, 18, 20, and 22 of a substantially rectangular, trapezoid or tapered shape. Each one of the top flaps 16, 18, 20, 22 is attached to one of the front 8, back 10 or side panels 12, 14, respectively, and is at least substantially coextensive in length with its attached panel. The top flaps 16, 18, 20, 22 are not attached to each other on their sides. Thus, the top flaps 16, 18, 20, 22 are disconnected from each other, with each having three free edges or sides (16*a*, 16*b*, 16*c*, 18*a*, 18*b*, 18*c*, 20*a*, 20*b*, 20*c*, 22*a*, 22*b*, 22*c*) and having only the bottom side (16*d*, 18*d*, 20*d*, 22*d*) attached to the front 8, back 10 or side panels 12, 14.

The front and the back panels 8, 10 each comprise two score lines 25*a*, 25*b*, 28*a*, 28*b* extending across the panels in such a way that the first score line 25*a*, 28*a* extends from the bottom corner 30, 32 (not shown in FIG. 1) to at least substantially the middle or the center of the top edge of the panels 8, 10, where it meets the second score line 25*b*, 28*b*, respectively, that extends from the other bottom corner 34, 36 to at least substantially the center of the top edge of the panels 8, 10. The two top flaps 16, 18 that are attached to the front and the back panels 8, 10 also each comprise one score line 38, 40 that extends across at least substantially the center of the flap 16, 18, respectively as a continuation of the two score lines 25*a* and 25*b*, 28*a* and 28*b* on the front 8 or the back 10 panel, respectively. This specific design allows the package 1 to be opened wide to accommodate insertion of a human hand or another large object for easy removal of the packaged goods. The design of the score lines, top flaps and materials of the carton further allows the package to stay open for a prolonged period of time even if the package rests on one of its front 8 or back 10 panels.

In the preferred embodiment the front 8 and the back 10 panels are usually substantially wider than the side panels 12, 14, and the width of the front 8 and the back 10 panels is less than about 80%, preferably less than about 75% of the height of the panels 8, 10.

The outer carton 5 can be conveniently made from a blank 50 of cardboard material as shown in FIG. 2*a* and FIG. 2*b*. The blank 50 shown in these figures comprises a rectangular front panel 8 having a top edge 52, a bottom edge 54, and first and second side edges 56 and 58; first and second rectangular side panels 12 and 14, with each of the side panels including a top edge 60 and 62, a bottom edge 64 and 66, and first and second side edges 68, 70, 72 and 74 respectively; and a rectangular back panel 10 including a top edge 76, a bottom edge 78, and first and second side edges 80 and 82.

The top flaps or panels for the recloseable top of the carton include a front top flap 16 including a top edge 16*c*, a bottom edge 16*d* and two opposing side edges 16*a* and 16*b*, a top back flap 18 including a top edge 18*c*, a bottom edge 18*d* and two opposing side edges 18*a* and 18*b*, and two opposing side top flaps 20 and 22 with each of the side top flaps 20, 22 including a top edge 20*c* and 22*c*, a bottom edge 20*d* and 22*d*, and two opposing side edges 20*a* and 20*b*, and 22*a* and 22*b* respectively.

The first edge 56 of the front panel 8 and the second edge 70 of the side panel 12 are connected at the edge 84 or about a fold line when folded into the form of the carton 5. The second edge 58 of the front panel 8 and the first edge 72 of the second side panel 14 are connected about a fold line 86. The first edge 80 of the back panel 10, and the second edge 74 of the second side panel 14 are connected about a fold line 88.

The bottom edge 16*d* of the front top flap 16 and the top edge 52 of the front panel 8 are connected about a fold line 90. The bottom edge 18*d* of the back flap panel 10 and the top edge 76 of the back panel 10 are connected about a fold line 92. The bottom edges 20*d*, 22*d* of the side top flaps 20 and 22 and the top edges 60, 62 of the side panels 12 and 14 are connected about fold lines 94 and 96, respectively. The side edges (16*a, b*, 18*a, b*, 20*a, b*, and 22*a, b*) of all four top flaps 16, 18, 20, 22 are disconnected from each other.

The blank 50 further comprises a glue flap 100 having first and second side edges 102, 104, with the first side edge 102 being connected about a fold line 106 to the second side edge 82 of the back panel 10. When the carton 5 is formed from the blank 50, the glue flap 100 is glued to the inside of the first side panel 12 so that the second edge 82 of the back panel 10 is connected to the first edge 68 of the first side panel 12. In other embodiments, the second side edge 104 of the glue flap 100 may be connected about a fold line to the first side edge 68 of the first side panel 12.

The blank 50 further comprises four bottom flaps or panels 108, 110, 112, and 114 connected to, and at least substantially coextensive with the bottom edges 54, 78, 64, 66 of the front, back and the side panels 8, 10, 12, 14, respectively. The bottom of the carton 5, which is at least substantially rectangular even after expansion of the carton, may be formed by sequentially inwardly folding the side bottom flaps 112, 114 or panels, the front bottom flap 108 and the back bottom flap 110, and securing or gluing the bottom front flap 108 to at least one, preferably to both bottom side flaps 112, 114, and to the bottom rear flap 110 to provide a tamper evident closed bottom. In other embodiments, the bottom front flap 108 may be folded upon and glued to a folded bottom rear flap 110. The bottom side flaps may include conventional perforations 116, 118 for enhancing adhesiveness of the glue.

Similarly, the top of the carton 5, which is at least substantially rectangular prior to opening and expansion, may be formed by sequentially inwardly folding the side top flaps 20, 22 or panels, the front top flap 16 and the back top flap 18, and securing or gluing the top front flap 16 to at least one, preferably to both of the top side flaps 20, 22 and to the top rear flap 18 to provide a tamper evident, closed rectangular top. In other embodiments, the top front flap 16 may be folded upon and glued to a folded top rear flap 18. The top side flaps 20, 22 may include conventional perforations 120, 122 for enhancing adhesiveness of the glue.

In the embodiment of FIGS. 1 and 2*a*, the front top flap 16 comprises a conventional C-shaped slot 125 and the back top flap 18 comprises a conventional tab 127. The slot 125 can be interlocked with the tab 127 making the package reclosable. In other embodiments, the front top flap 16 may comprise the tab 127 and the back top flap 18 may comprise the slot 125.

In the embodiment of FIG. 2*b*, the back top flap 18 may comprise three different tabs 130, 132 and 134 and the front top flap 16 may comprise a centrally located conventional C-shaped slot 136 as a part of a conventional easy-open tab arrangement. In this arrangement, the middle tab 132 interlocks with the slot 136. In other embodiments, the front top flap 16 may comprise the three tabs 130, 132, 134 and the back top flap 18 may comprise the slot 136.

The front and the back panels 8, 10 comprise score lines 25*a*, 25*b*, 28*a* and 28*b* extending across the panels 8, 10 from the bottom corners 30, 34, and 32, 36, respectively to the center of the top edges. These score lines are extended across the top front and the top rear flaps 16 and 18 as score lines 38 and 40, respectively. The score lines 38, 40 in the top flaps 16, 18 may intersect or meet with the score lines 25*a*, 25*b*, and 28*a*, 28*b* in the front or back panels 8, 10, respectively or they may be slightly spaced therefrom.

The blank 50 may be produced in conventional manner, using conventional die-stamping and scoring equipment and processes. The score lines may be made to a standard depth and channel-shaped to provide clean or at least substantially straight bending or folding of the blank without cracking of the paperboard. The carton 5 formed from the blank 50 described above is fitted with an inner bag 7 to form a package 1 according to the invention.

When the package 1 according to the invention is opened on the top, it can be gently squeezed to flex the front and the back panels 8 and 10 into a non-planar shape and to form a substantially hexagonal opening on top wide enough to insert a human hand and remove the contents of the package. When the front and the back panels 8, 10 of the carton 5 are flexed in a non-planar shape, the distance between the centers of the front and rear top edges 52 and 76 becomes greater than the width of the side edges 60 or 62. Also, the distance between the side top edges 60 and 62 becomes less than the original, or non-flexed width of the front or the back panels 8, 10. When the squeezing force is removed, the package 1 will continue to stay opened for as long as it is intended by the user of the packaged product, and then the package 1 can be returned to the original parallelepiped form by applying inwardly directed force to the front and the back panels 8, 10.

Figure 3:
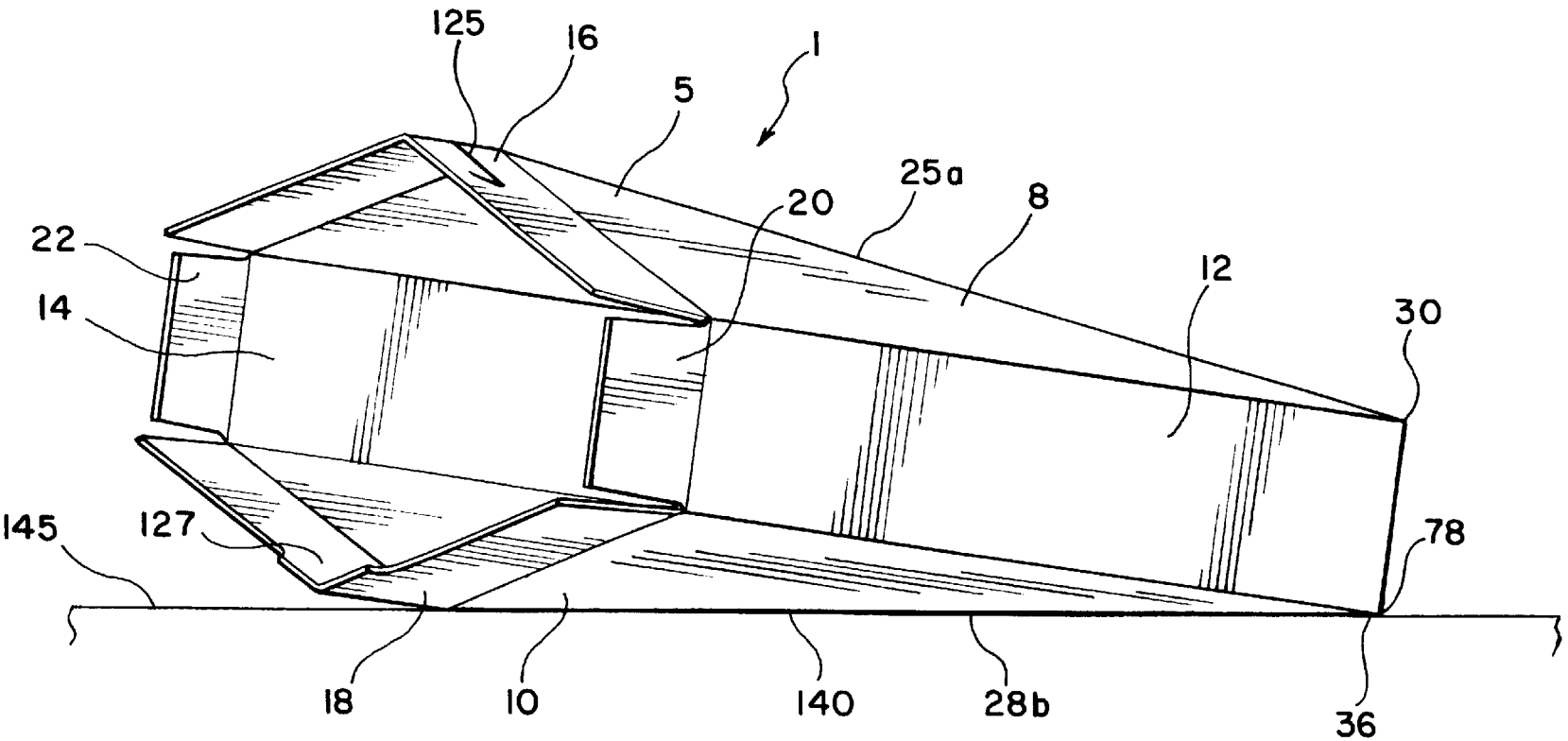
FIG. 3 shows a side view of the opened package of FIG. 1 resting on the back panel of the carton for snacking.

As shown in FIG. 3, the package 1 (shown without the liner 7) retains its expanded or flexed shape and hexagonal opening even when laid or rested on one of its major panels 8 or 10. In FIG. 3 the package 1 and its contents are essentially fully, stably supported solely by the essentially flat, triangular portion 140 of the rear panel 10 bordered by the rear panel score lines 28*a*, 28*b* and bottom rear edge 78 (also shown in FIGS. 2*a* and 2*b*). The expanded configuration is maintained during snacking without the need for external hand support. Also, the expanded package does not tip or rock during snacking, but rather keeps a stable contact with an underlying at least substantially flat support surface 145.

What is claimed is:

1. A food package for snacks comprising a carton and a liner bag inside said carton, said carton comprising:

a front panel, a back panel, a first side panel, and a second side panel, all of said panels each having a top edge, a bottom edge, and first and second side edges, the first edge of the front panel and the second edge of the first side panel being connected about a fold line, the second edge of the front panel and the first edge of the second side panel being connected about a fold line, the first edge of the back panel and the second edge of the second side panel being connected about a fold line, and the second edge of the back panel and the first edge of the first side panel being connected about a fold line;

a front top flap, a back top flap, and two opposing side top flaps, all of said top flaps each including a top edge, a bottom edge, and two opposing side edges, the bottom edge of the front flap and the top edge of the front panel being connected about a fold line, the bottom edge of the back flap and the top edge of the back panel being connected about a fold line, the bottom edges of the side flaps and the top edges of the side panels being connected about fold lines, and the side edges of all four flap panels being disconnected from each other;

the width between the side edges of each of the front panel and the back panel being substantially larger than the width between the side edges of each of the first and second side panels;

the width between the side edges of each of said front and said back panels being less than about 80% of the height between the top and the bottom edges of each of said front and said back panels;

a bottom closing holding the bottom edges of the front panel, the side panels and the back panels in a substantially rectangular configuration; and score lines allowing the front and back panels to flex into a non-planar shape with each of the front, side, and back flaps being open and the top edges of the front, side and back panels forming a generally hexagonal shape having a distance between the centers of the front top edge and the back top edge substantially greater than the width between the side edges of each of the first and second side panels, said score lines further allowing the carton to stay open when resting on the front or the back panel, wherein two score lines extend across the front panel, one from each of the bottom corners of the front panel to the center of the top edge of the front panel, two score lines extend across the back panel one from each of the bottom corners of the back panel to the center of the top edge of the back panel, and a score line extends substantially parallel to the side edges and across the center of each of said top front and top back flaps.

2. A package as claimed in claim 1, wherein said carton is a reclosable carton, with one of said front top flap and said back top flap further comprising a tab, and the other of said front and back top flaps further comprising a slot which interlocks with said tab.

3. A package as claimed in claim 2, wherein said back top flap comprises said tab, and said front top flap comprises said slot which interlocks with said tab.

4. A package as claimed in claim 1, wherein said carton is a reclosable carton with one of said front top flap and said back top flap further comprising three tabs, and the other of said front and back top flaps further comprising a slot which interlocks with a middle tab of said three tabs.

5. A package as claimed in claim 4, wherein said back top flap comprises said tabs, and said front top flap comprises said slot which interlocks with said middle tab.

6. A package as claimed in claim 1, wherein said liner is resealable.

7. A package as claimed in claim 1, wherein said liner is spot-glued to said carton.

8. A package as claimed in claim 1, wherein said liner is not attached to said carton.

9. A blank form for a carton comprising:

a front panel, a back panel, a first side panel, and a second side panel, all of said panels each having a top edge, a bottom edge, and first and second side edges, the first edge of the front panel and the second edge of the first side panel being connected about a fold line, the second edge of the front panel and the first edge of the second side panel being connected about a fold line, the first edge of the back panel and the second edge of the second side panel being connected about a fold line;

a glue flap comprising a first side edge and a second side edge, one of said edges of said glue flap being connected about a fold line to one of said second side edge of said back panel or said first side edge of said first side panel;

a front top flap, a back top flap, and two opposing side top flaps, all of said top flaps each including a top edge, a bottom edge, and two opposing side edges, the bottom edge of the front flap and the top edge of the front panel being connected about a fold line, the bottom edge of the back flap and the top edge of the back panel being connected about a fold line, the bottom edges of the side flaps and the top edges of the side panels being connected about fold lines, and the side edges of all four flap panels being disconnected from each other;

the width between the side edges of each of the front panel and the back panel being substantially larger than the width between the side edges of each of the first and second side panels;

the width between the side edges of each of said front and said back panels being less than about 80% of the height between the top and the bottom edges of each of said front and said back panels;

bottom flaps connected about fold lines to the bottom edges of the front panel, the side panels and the back panels; and score lines allowing the front and back panels to flex into a non-planar shape, said score lines further allowing the carton to stay open when resting on the front or the back panel, wherein two score lines extend across the front panel, one from each of the bottom corners of the front panel to the center of the top edge of the front panel, two score lines extend across the back panel one from each of the bottom corners of the back panel to the center of the top edge of the back panel, and a score line extends substantially parallel to the side edges and across the center of each of said top front and top back flaps.

10. A blank form for a carton as claimed in claim 9 wherein the first edge of said glue flap and said second side edge of said back panel are connected about a fold line.

11. A blank form for a carton as claimed in claim 9 wherein one of said front top flap and said back top flap further comprises a tab, and the other of said front and back top flaps further comprises a slot for interlocking with said tab.

12. A blank form for a carton as claimed in claim 11 wherein said back top flap comprises said tab, and said front top flap comprises said slot which interlocks with said tab.

13. A blank form for a carton as claimed in claim 9 wherein one of said front top flap and said back top flap further comprises three tabs, and the other of said front and back top flaps further comprises a slot which interlocks with a middle tab of said three tabs.

14. A blank form for a carton as claimed in claim 13 wherein said back top flap comprises said tabs, and said front top flap comprises said slot which interlocks with said middle tab.

15. A recloseable snack package for hand-to-mouth snacking comprising a carton and a liner bag inside said carton, wherein said carton comprises a front panel and a back panel each of a substantially planar rectangular shape when the package is closed, the width of the front and the back panel being less than about 80% of the height of the front or the back panels, and score lines for allowing the front and back panels to flex into a non-planar shape, wherein two score lines extend across the front panel, one from each of the bottom corners of the front panel to the center of the top edge of the front panel, and two score lines extend across the back panel, one from each of the bottom corners of the back panel to the center of the top edge of the back panel, said score lines allowing the package to stay opened in said non-planar shape during hand-to-mouth snacking for a prolonged period of time without the application of external pressure to the package.

16. A reclosable package as claimed in claim 15, wherein said carton comprises a top flap with at least one tab, and a top flap with a slot which interlocks with said tab for reclosing said package.

17. A reclosable package as claimed in claim 16, wherein said liner is resealable.

18. A reclosable package as claimed in claim 16, wherein said liner is spot-glued to said carton.

19. A reclosable package as claimed in claim 16, wherein said liner is not attached to said carton.

* * * * *